United States Patent [19]

Schick et al.

[11] Patent Number: 4,492,590

[45] Date of Patent: Jan. 8, 1985

[54] STABILIZERS FOR OIL SLURRIES OF CARBONACEOUS MATERIAL

[75] Inventors: Martin J. Schick, New York, N.Y.; Edwin L. Kelley, Succasunna, N.J.

[73] Assignee: Diamond Shamrock Chemicals Company, Dallas, Tex.

[21] Appl. No.: 447,315

[22] Filed: Dec. 6, 1982

[51] Int. Cl.[3] ..... C10L 1/32

[52] U.S. Cl. ..... 44/51; 44/53; 44/63; 44/72; 252/357; 548/352

[58] Field of Search ..... 44/51, 72, 63, 53; 252/357; 548/352

[56] References Cited

U.S. PATENT DOCUMENTS 4,364,741 12/1982 Villa ..... 44/51
4,364,742 12/1982 Knitter ..... 44/51

FOREIGN PATENT DOCUMENTS 56-88495 7/1981 Japan ..... 44/51
57-23688 2/1982 Japan ..... 44/51

*Primary Examiner*—William R. Dixon, Jr.
*Assistant Examiner*—Margaret B. Medley
*Attorney, Agent, or Firm*—Neal T. Levin

[57] ABSTRACT

Slurries of carbonaceous material in oil, particularly coal, are stabilized with particular tertiary amines. An example is tallow amine first condensed with two moles of propylene oxide and then condensed with thirteen moles of ethylene oxide.

18 Claims, No Drawings

STABILIZERS FOR OIL SLURRIES OF CARBONACEOUS MATERIAL

BACKGROUND OF THE INVENTION

1. Field of the Invention

This invention relates to slurries of solid particulate carbonaceous material in oil and more particularly to stabilized coal in oil slurries containing particular tertiary amine and tertiary amine, imidazoline blends as stabilizers.

2. Description of the Prior Art

Addition of solid, particulate carbonaceous material, such as coal or coke, to a liquid hydrocarbon fuel, such as fuel oil, has been done. The object is to achieve slurry stability with a large amount of particulate carbonaceous material present to reduce the amount of liquid hydrocarbon.

For example, U.S. Pat. No. 4,201,552—Rowell et al, May 6, 1980, describes coal oil slurries stabilized with particular cationic surfactants containing the group $$>N-CH_2-CH_2-O-$$

wherein the group forms part of a straight chain such as in Ethomeen C-20 having the structure

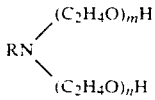

where R is $C_{16}$ and m+n is 10 or part of a cyclic ring such as in N-soya-N-ethyl morpholinium ethosulfate. The slurries contain coal concentrations up to about 60 weight percent based on the weight of the mixture.

CA94:124463p corresponding to Japanese No. 80/152785 describes stabilizers for coal-fuel oil dispersions wherein the stabilizer is an amine ethylene oxide-propylene oxide block polymer having from 20 to 800 moles ethylene oxide and 15 to 200 moles propylene oxide.

SUMMARY OF THE INVENTION

Slurries of carbonaceous materials in oil are stabilized by one or more tertiary amines of the following structure:

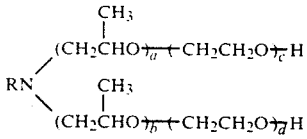

where R is a straight or branched saturated or unsaturated hydrocarbon chain of 12 to 18 carbon atoms, a+b totals from about 2 to about 4 and c+d totals from about 7 to about 22.

As shown in the subsequent examples, tertiary amines containing two moles of propylene oxide (see Example III, Table B) are ineffective stabilizers. However, the further addition of varying amounts of ethylene oxide brings about a very effective stabilizer which is not only comparable to tertiary amines containing varying amounts of ethylene oxide, but in one instance surpasses these where an equal number of alkylene oxide units are compared (see Example II, Table B).

Optionally, blends of the above tertiary amines with imidazolines can be used. These stabilizers are added to slurries of carbonaceous materials in oil such as a coal oil mixture or a coke oil mixture in an amount sufficient to stabilize the slurries during transport and storage at various temperatures. The stabilizers are added to either the oil or slurry or during grinding of the carbonaceous material and are effective with or without addition of water. Slurries may contain from about 40 to about 90 parts by weight of oil, about 10 to about 60 parts by weight of particulate carbonaceous material, about 0.01 to about 10 parts by weight of the stabilizer and optionally up to about 20 parts by weight of water.

Further, it has been found that when at least 50% by weight of stabilizer is added to imidazoline quaternary salt, performance of the salt is improved.

DESCRIPTION OF THE PREFERRED EMBODIMENTS

Tertiary Amine

The tertiary amine stabilizers have the following structure:

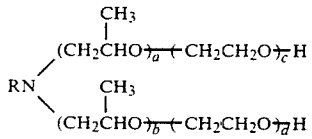

where R is a straight or branched saturated or unsaturated hydrocarbon chain of 12 to 18 carbon atoms a+b totals from about 2 to about 4 and c+d totals from about 7 to about 22.

Examples of R are: lauryl ($C_{12}$), myristyl ($C_{14}$), palmityl ($C_{16}$), stearyl ($C_{18}$), lauroleyl ($C_{12}$), myristoleyl ($C_{14}$), palmitoleyl ($C_{16}$), oleyl ($C_{18}$) and their mixtures such as are obtained from tallow and coco fatty acids.

Examples of these stabilizers are:

| R | a + b | c + d |
|---|---|---|
| derived from tallow fatty acids | 2 | 7 |
| " | 2 | 13 |
| " | 2 | 17 |
| " | 2 | 18 |
| " | 2 | 22 |
| " | 4 | 11 |
| " | 4 | 15 |

The stabilizers are prepared by first reacting a primary amine having the requisite alkyl or mixture of alkyl groups with propylene oxide, generally at temperatures of from about 110° C. to about 130° C. and at 45 psi pressure in the presence of an alkaline catalyst such as sodium methylate and then reacting the resulting propylene oxide adduct of the amine with ethylene oxide, generally at temperatures of from about 150° C. to about 180° C. and at 45 psi pressure in the presence of an alkaline catalyst such as sodium methylate. Preparation of the stabilizers thus follows conventional alkoxylation processes and such processes do not form a part of the present invention.

Blends of Imidazoline Quaternary Salts

Use of the stabilizers with particular imidazoline quaternary salts which are described in U.S. application Ser. No. 247,702, Villa, filed Mar. 26, 1981, now U.S. Pat. No. 4,364,741, improve performance of the latter. Preferably, there is present at least 50% by weight of the total of the tertiary amines of this invention. The imidazoline quaternary salts are 1-hydroxyalkyl 2-hydrocarbyl imidazoline quaternary salts having the formula:

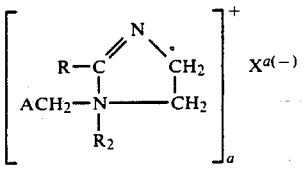

wherein:

R is a hydrocarbon radical having 9 to 23 carbon atoms, A is a $$HOCH_2-,\ HO-\overset{CH_3}{\overset{|}{C}}H-,\ R_3CONHCH_2-\ \text{or}\ R_3CONH\overset{CH_3}{\overset{|}{C}}H-$$

radical where $R_3$ is oleyl or stearyl, $R_2$ is hydrogen, unsubstituted or hydroxy-substituted aliphatic hydrocarbon radical having 1 to 6 carbon atoms or benzyl radical, X is a water-soluble anion, and a is a number equal to the ionic valence of the anion, X.

Compounds of this general formula are known and may be made by quaternizing (e.g. with a $C_1$-$C_6$ hydrocarbon or benzyl halide or sulfate) an imidazoline produced by the dehydration cyclization of an amide resulting from the reaction of a $C_{10}$ to $C_{24}$ aliphatic hydrocarbonoic acid and either 2-hydroxyethyl ethylene diamine or 2-hydroxyisopropyl ethylene diamine as described in U.S. Pat. Nos. 2,268,273 and 3,669,608.

In these imidazoline compounds, R, is saturated or unsaturated; linear, branched, or cyclic or composed of a mixture of the $C_9$-$C_{23}$ hydrocarbons. Illustrative of acids that may be used in producing the compounds and form the hydrocarbon radical, R, are lauric, palmitic, stearic, erucic, oleic, linoleic, linolenic and tallow acids. As will be appreciated, the commercial technical grades of these and other acids which may be used to produce the imidazoline compounds as hereinbefore described normally contain considerable minor quantities of hydrocarbons outside the $C_9$ to $C_{23}$ range. Therefore, the imidazoline compounds prepared from such acids may contain minor quantities of compounds having 2-hydrocarbyl groups having less than 9 or more than 23 carbon atoms.

$R_2$ is hydrogen or any unsubstituted or hydroxysubstituted hydrocarbon radical having 1 to 6 carbon atoms that is linear, branched, or cyclic, and either saturated or unsaturated, or may be a benzyl radical such as when the imidazoline compounds are quaternized for example with a $C_1$-$C_6$ hydrocarbon or benzyl halide or sulfate or with an active epoxide such as ethylene or propylene oxide.

The anion, X, is not critical and may be $Cl^-$, $Br^-$, $CH_3COO^-$, $C_2H_5SO_4^-$, $CH_3SO_4^-$, or like anion. Sources of these and other anions are the following quaternizing agents: diethylsulfate, dimethylsulfate, methyl chloride, methyl bromide, ethyl chloride, benzyl chloride, dodecylbenzyl chloride, butyl chloride, epichlorohydrin, ethyl chloroacetate and alkyl p-toluenesulfonate. Generally preferred because of their lower costs are the chloride, methosulfate and ethosulfate anions.

Examples of imidazoline quaternary salts are one or more of:

- oleyl hydroxyethyl imidazoline quaternized with diethyl sulfate,
- stearyl hydroxyethyl imidazoline quaternized with diethyl sulfate,
- hydrogenated coco hydroxyethyl imidazoline quaternized with diethyl sulfate,
- oleyl-2-amidoethylimidazoline quaternized with diethyl sulfate,
- stearyl-2-amidoethylimidazoline quaternized with diethyl sulfate.

Oils suitable for these slurries include fuel oils such as No. 6 fuel oil, No. 2 fuel oil as well as other liquid petroleum products such as gas oils and crude oils used as fuel oils or the like.

Powdered coal used in these slurries may be pulverized bituminous, anthracite, or semi-bituminous coal. If desired, finely-divided solid carbonaceous materials such as powdered coke from coal or petroleum may be used in these slurries.

At room temperature, when a uniformly mixed coal oil slurry or coke oil slurry is prepared, the viscous fuel oil usually holds powdered carbonaceous material in suspension. Later, when the slurry is heated so that the slurry can be pumped, the oil viscosity decreases and the particles tend to settle. The quantity of stabilizer added initially to the slurry should be sufficient to keep the particles suspended at elevated temperatures. To test the stabilizing effect of various additives, coal oil mixtures were prepared and then heat aged. The following procedure was used to evaluate coal oil slurries containing the stabilizers described above.

Evaluation of Stabilizers

The products of the examples were evaluated in coal oil slurries. This involved determining their ability to disperse or suspend coal dust uniformly in oil by examining the degree of settling of the coal and the nature of the sediment. The specific procedure used in all of the examples is set forth in Example I.

Throughout, all quantities, proportions and percentages are by weight and all references to temperature are in °C. unless otherwise indicated.

For a fuller understanding of the nature and advantages of this invention, reference may be made to the following examples. These examples are given merely to illustrate the invention and are not to be construed in a limiting sense.

EXAMPLE I

The effect of various alkoxylated tallow amine stabilizers on the consistency of slurries of coal and oil containing 0.35%, 0.20% or 0.10% by weight of stabilizer based on the weight of slurry was examined. The slurry compositions are given in Table A and evaluation data are given in Tables B and C. The following alkoxylated tallow amines were used:

Tallow amine $(EO)_{15}$

Tallow amine $(PO)_2(EO)_{13}$
Tallow amine $(PO)_2(EO)_{18}$
Catamine T-1C $(PO)_2(EO)_{13}$
Catamine T-1C $(PO)_2(EO)_{17}$
Catamine T-1C $(PO)_2(EO)_{22}$ where EO signifies ethylene oxide and PO, propylene oxide.

The alkoxylated tallow amines were prepared from Adogen 170 (Sherex Chemical Company), which is a primary tallow amine produced by reaction of tallow fatty acids with ammonia with the following specifications: The approximate combining weight is 265, the primary amine value is 204 minimum, the secondary and tertiary amine value is 7.0 maximum, the primary amine content is 95.0%, the iodine value is 38 minimum and the moisture is 0.5% maximum.

Catamine T-1C is a crude grade of tallow primary amine (Nostrip Chemical Works, Inc.) produced by reaction of tallow fatty acids with ammonia, with the following specifications: The total amine value is 140 minimum, the secondary and tertiary amine value is 30 maximum, the iodine value is 38 minimum and the moisture content is 0.5% maximum.

Tallow fatty acids is a mixture of fatty acids containing predominately palmitic ($C_{16}$), stearic ($C_{18}$) and oleic ($C_{18}$) acids.

weekly intervals over a period of four weeks in the following manner. The rod is pushed along the bottom toward the center for a distance of about ½ inch. The deposit is soft when the rod moves easily with no resistance; semi-firm when there is some resistance and the slurry clings to the rod without falling away when it is withdrawn; and firm when the rod does not move. The results are translated into a numerical rating system as shown below for this and other examples. The highest number signifies optimum peformance and vice versa. The values in inches represent sediment height in the jar. In this and other examples, where the terms S and SF are used, Soft and Semi-Firm respectively, are meant. Also, in all of the examples, in the rating system, S is 16 and SF is 8. Further, in this and other examples, on reaching a SF (Semi-Firm) slurry, measurements were discontinued.

TABLE A

| Component | % By Wt. |
|---|---|
| Pittston Coal or Ashland Coal (80% <200 mesh U.S. Sieve Series) | 30 |
| Fuel Oil No. 6 | 67.65, 67.80 or 67.90 |
| Distilled Water | 2 |
| Stabilizer | 0.35, 0.20 or 0.10 |
| Total | 100 |

TABLE B

| | | PITTSTON COAL | | | | |
|---|---|---|---|---|---|---|
| | | Sediment | | | | |
| Stabilizer | Conc. (% By Wt.) | 1 Week | 2 Weeks | 3 Weeks | 4 Weeks | Total Rating |
| 1-Hydroxyethyl ethyl-2-heptadecenyl imidazoline quaternary ethyl sulfate. | 0.35 | 1" S | 1" SF | — | — | 72 |
| | 0.20 | 1" S | 1" SF | — | — | |
| | 0.10 | 1" S | 1" SF | — | — | |
| Tallow amine $(EO)_{15}$ | 0.35 | 1" S | 1" S | 1" S | 1" SF | 168 |
| | 0.20 | 1" S | 1" S | 1" S | 1" SF | |
| | 0.10 | 1" S | 1" S | 1" S | 1" SF | |
| Tallow amine $(PO)_2(EO)_{13}$ | 0.35 | 1" S | 1" S | 1" S | 1" SF | 152 |
| | 0.20 | 1" S | 1" S | 1" S | 1" SF | |
| | 0.10 | 1" S | 1" S | 1" SF | — | |
| Tallow amine $(PO)_2(EO)_{18}$ | 0.35 | 1" S | 1" S | 1" S | 1" S | 176 |
| | 0.20 | 1" S | 1" S | 1" S | 1" SF | |
| | 0.10 | 1" S | 1" S | 1" S | 1" SF | |
| Catamine T-1C $(PO)_2(EO)_{13}$ | 0.35 | 1" S | 1" S | 1" S | 1" S | 184 |
| | 0.20 | 1" S | 1" S | 1" S | 1" S | |
| | 0.10 | 1" S | 1" S | 1" S | 1" SF | |
| Catamine T-1C $(PO)_2(EO)_{17}$ | 0.35 | 1" S | 1" S | 1" S | 1" S | 168 |
| | 0.20 | 1" S | 1" S | 1" S | 1" S | |
| | 0.10 | 1" S | 1" S | 1" SF | — | |
| Catamine T-1C $(PO)_2(EO)_{22}$ | 0.35 | 1" S | 1" S | 1" S | 1" S | 160 |
| | 0.20 | 1" S | 1" S | 1" S | 1" SF | |
| | 0.10 | 1" S | 1" S | 1" SF | — | |

A quaternized imidazoline which is a reaction product of oleic acid, aminoethylethanolamine and diethyl sulfate is also present in Tables B and C.

The experimental procedure was as follows. Coal powder was added slowly with agitation to heated oil (70° C.). After addition of all of the coal to the oil, the sides of the jar were scraped to remove any coal adhering to the walls. The slurry was mixed for 10 to 15 minutes until it was uniform. Then 98 gram portions of slurry were poured into 4 ounce jars and 2 gram portions of distilled water were added to each jar. Then, 0.35 gram, 0.20 gram and 0.10 gram portions of stabilizer were added, each to a different jar, the jars placed into an oven maintained at 70° C. and mixed again until the slurry was completely uniform. Slurry consistency was assessed with a 3/16 inch diameter glass rod at It is evident from the data of Table B that all slurries stabilized with alkoxylated amines performed better than slurries stabilized with quaternized imidazoline. With only a few exceptions, sediments of slurries stabilized with alkoxylated amines remained soft for a period of three weeks. With Pittston Coal, the slurry stabilized with Catamine T-1C $(PO)_2(EO)_{13}$ showed optimum performance and performance decreased with increasing ethylene oxide content to $(EO)_{17}$ and $(EO)_{22}$. In contrast, over a shorter range of ethylene oxide chain length, the slurry stabilized with tallow amine $(PO)_2(EO)_{18}$ performed better than that with tallow amine $(PO)_2(EO)_{13}$ and in both adducts propylene oxide addition enhanced performance at optimum ethylene oxide chain length.

TABLE C

| Stabilizer | Conc. (% By Wt.) | ASHLAND COAL Sediment 1 Week | 2 Weeks | 3 Weeks | 4 Weeks | Total Rating |
|---|---|---|---|---|---|---|
| 1-Hydroxyethyl ethyl- | 0.35 | 1" S | 1" SF | — | — | 136 |
| 2-heptadecenyl imid- | 0.20 | 1" S | 1" S | 1" S | 1" SF | |
| azoline quaternary | 0.10 | 1" S | 1" S | 1" S | 1" SF | |
| ethyl sulfate | | | | | | |
| Tallow amine $(EO)_{15}$ | 0.35 | 1" S | 1" S | 1" S | 1" SF | 152 |
| | 0.20 | 1" S | 1" S | 1" S | 1" SF | |
| | 0.10 | 1" S | 1" S | 1" SF | — | |
| Tallow amine | 0.35 | 1" S | 1" S | 1" S | 1" SF | 120 |
| $(PO)_2(EO)_{13}$ | 0.20 | 1" S | 1" S | 1" SF | — | |
| | 0.10 | 1" S | 1" SF | — | — | |
| Tallow amine | 0.35 | 1" S | 1" S | 1" S | 1" SF | 120 |
| $(PO)_2(EO)_{18}$ | 0.20 | 1" S | 1" S | 1" SF | — | |
| | 0.10 | 1" S | 1" SF | — | — | |
| Catamine T-1C | 0.35 | 1" S | 1" S | 1" S | 1" S | 176 |
| $(PO)_2(EO)_{13}$ | 0.20 | 1" S | 1" S | 1" S | 1" SF | |
| | 0.10 | 1" S | 1" S | 1" S | 1" SF | |
| Catamine T-1C | 0.35 | 1" S | 1" S | 1" S | 1" SF | 136 |
| $(PO)_2(EO)_{17}$ | 0.20 | 1" S | 1" S | 1" S | 1" SF | |
| | 0.10 | 1" S | 1" SF | — | — | |
| Catamine T-1C | 0.35 | 1" S | 1" S | 1" S | 1" SF | 120 |
| $(PO)_2(EO)_{22}$ | 0.20 | 1" S | 1" S | 1" SF | — | |
| | 0.10 | 1" S | 1" SF | — | — | |

It is evident from the data of Table C that the slurry stabilized with quaternized imidazoline performed intermediate among those stabilized with alkoxylated amines. With only a few exceptions, sediments of the slurries stabilized with alkoxylated amines remained soft for a period of two weeks. With Ashland Coal, the slurry stabilized with Catamine T-1C $(PO)_2(EO)_{13}$ showed optimum performance and the performance decreased with increasing ethylene oxide content to $(EO)_{17}$ and $(EO)_{22}$. No difference in performance was observed with the slurries stabilized with tallow amine $(PO)_2(EO)_{13}$ and tallow amine $(PO)_2(EO)_{18}$.

EXAMPLE II

The effect of various alkoxylated tallow amine stabilizers on the consistency of slurries of coal and oil containing 0.35%, 0.20% or 0.10% by weight of stabilizer based on the weight of slurry was examined. The slurry compositions are given in Table A and evaluation data are given in Tables B and C. The following alkoxylated tallow amines were used:

Tallow amine $(EO)_{15}$
Tallow amine $(PO)_2(EO)_{13}$
Tallow amine $(PO)_2(EO)_{18}$
Catamine T-1C $(EO)_{15}$
Catamine T-1C $(EO)_{25}$ The sources of the fatty acid portions were the same as described in Example I.

A quaternized imidazoline is also present in Tables B and C and is the same as used in Example I.

Slurry preparation, experimental procedure and rating system were the same as described in Example I.

TABLE A

| Component | % By Wt. |
|---|---|
| Pittston Coal or Falcon Coal (80% <200 mesh (U.S. Sieve Series) | 30 |
| Fuel Oil No. 6 | 67.65, 67.80 or 67.90 |
| Distilled Water | 2 |
| Stabilizer Mixture | 0.35, 0.20 or 0.10 |
| Total | 100 |

TABLE B

| Stabilizer | Conc. (% By Wt.) | PITTSTON COAL Sediment Week | 2 Weeks | 3 Weeks | 4 Weeks | Total Rating |
|---|---|---|---|---|---|---|
| 1-Hydroxyethyl ethyl- | 0.35 | 1 1/16" S | 1" SF | — | — | 72 |
| 2-heptadecenyl imid- | 0.20 | 1 1/16" S | 1" SF | — | — | |
| azole quaternary ethyl | 0.10 | 1" S | 1" SF | — | — | |
| sulfate | | | | | | |
| Tallow amine $(EO)_{15}$ | 0.35 | 1" S | 1 1/16" S | 1⅛" S | 1 1/16" SF | 168 |
| | 0.20 | 1" S | 1 1/16" S | 1 1/16" S | 1¼" SF | |
| | 0.10 | 1" S | 1 3/16" S | 1¼" S | 1 3/16" SF | |
| Catamine T-1C $(EO)_{25}$ | 0.35 | 1" S | 1 3/16" S | 1 1/16" S | 1" SF | 168 |
| | 0.20 | 1" S | 1⅛" S | 1⅛" S | 1" SF | |
| | 0.10 | 1" S | 1" S | 1⅛" S | 1" SF | |
| Catamine T-1C $(EO)_{15}$ | 0.35 | 1 1/16" S | 1⅛" S | 1 1/16" SF | — | 136 |
| | 0.20 | 1⅛" S | 1 3/16" S | 1⅛" SF | — | |
| | 0.10 | 1⅛" S | 1⅛" S | 1⅛" S | 1⅛" SF | |
| Tallow amine $(PO)_2(EO)_{13}$ | 0.35 | 1 3/16" S | 1 3/16" S | 1⅛" S | 1" S | 192 |
| | 0.20 | 1⅛" S | 1 1/16" S | 1⅛" S | 1" S | |
| | 0.10 | 1⅛" S | 1⅛" S | 1⅛" S | 1 3/16" S | |
| Tallow amine $(PO)_2(EO)_{18}$ | 0.35 | 1 3/16" S | 1⅛" S | 1 3/16" S | 1⅛" SF | 168 |
| | 0.20 | 1" S | 1 3/16" S | 1 3/16" S | 1⅛" SF | |
| | 0.10 | 1⅛" S | 1¼" S | 1 3/16" S | 1⅛" SF | |

It is evident from the data of Table B that all slurries stabilized with alkoxylated amines performed better than those slurries stabilized with quaternized imidazoline. With only a few exceptions, sediments of the slurries stabilized with alkoxylated amines remained soft for a period of three weeks. With Pittston Coal, tallow amine $(PO)_2(EO)_{13}$ at optimum chain length performed better than tallow amine $(EO)_{15}$ or Catamine T-1C $(EO)_{15}$ and Catamine T-1C $(EO)_{25}$. It is clearly evident that insertion of two propylene oxide groups between the hydrophobe and ethylene oxide adduct markedly improved performance of the stabilizer. Increasing the ethylene oxide chain length from tallow amine $(PO)_2(EO)_{13}$ to tallow amine $(PO)_2(EO)_{18}$ decreased performance of the stabilizer.

EXAMPLE III

The effect of various alkoxylated tallow amine stabilizers on the consistency of slurries of coal and oil containing 0.35%, 0.20% or 0.10% by weight of stabilizer based on the weight of slurry was examined. The slurry compositions are given in Table A and the evaluation data are given in Tables B and C. The following alkoxylated amines were used:

Tallow amine $(PO)_2$
Tallow amine $(PO)_2(EO)_7$

TABLE C

| Total Stabilizer | Conc. (% By Wt.) | FALCON COAL Sediment 1 Week | 2 Weeks | 3 Weeks | 4 Weeks | Total Rating |
|---|---|---|---|---|---|---|
| 1-Hydroxyethyl ethyl-2-heptadecenyl imidazoline quaternary ethyl sulfate | 0.35 | 1" S | ⅞" SF | — | — | 88 |
| | 0.20 | 1" S | ⅞" SF | — | — | |
| | 0.10 | 1⅛" S | 1" S | 1" SF | — | |
| Tallow amine $(EO)_{15}$ | 0.35 | 1⅛" S | 1 1/16" S | 1⅛" S | 1¼" S | 160 |
| | 0.20 | 1⅛" S | 1" S | 1 1/16" S | 1⅛" SF | |
| | 0.10 | 1⅛" S | 1" S | 1 1/16" SF | — | |
| Catamine T-1C $(EO)_{25}$ | 0.35 | 1¼" S | 1⅛" S | 1 1/16" S | 1 1/16" S | 144 |
| | 0.20 | 1⅞" S | 1¼" S | 1⅛" S | 1⅛" SF | |
| | 0.10 | 1¼" S | 1⅛" SF | — | — | |
| Catamine T-1C $(EO)_{15}$ | 0.35 | 1 3/16" S | 1⅛" S | 1⅛" S | 1⅛" SF | 152 |
| | 0.20 | 1 3/16" S | 1⅛" S | 1⅛" S | 1" SF | |
| | 0.10 | 1⅛" S | 1⅛" S | 1⅛" SF | — | |
| Tallow amine $(PO)_2(EO)_{13}$ | 0.35 | 1 3/16" S | 1 1/16" S | 1⅛" S | 1¼" SF | 152 |
| | 0.20 | 1¼" S | 1⅛" S | 1⅛" S | 1⅛" SF | |
| | 0.10 | 1¼" S | 1 3/16" S | 1⅛" SF | — | |
| Tallow amine $(PO)_2(EO)_{18}$ | 0.35 | 1 3/16" S | 1¼" S | 1⅛" S | 1¼" SF | 152 |
| | 0.20 | 1⅛" S | 1⅛" S | 1" S | 1⅛" SF | |
| | 0.10 | 1 3/16" S | 1⅛" S | 1 1/16" SF | — | |

It is evident from the data of Table C that all slurries stabilized with alkoxylated amines performed better than those slurries stabilized with quaternized imidazoline. With only a few exceptions the sediments of the slurries stabilized with alkoxylated amines remained soft for a period of three weeks. With Falcon coal, tallow amine $(PO)_2(EO)_{13}$ performed about equal to tallow amine $(EO)_{15}$ or Catamine T-1C $(EO)_{15}$ and Catamine T-1C $(EO)_{25}$. In contrast to Pittston coal slurries, in Falcon coal slurries, the insertion of two propylene oxide groups between the hydrophobe and ethylene oxide adduct showed no marked effect on the performance of the stabilizer. Likewise, increasing the ethylene oxide chain length from tallow amine $(PO)_2(EO)_{13}$ to tallow amine $(PO)_2(EO)_{18}$ showed no marked change in the performance of the stabilizer.

The sources of the fatty acid portions were the same as described in Example I.

Slurry preparation, experimental procedure and rating system were the same as described in Example I.

TABLE A

| Component | % By Wt. |
|---|---|
| Pittston Coal (80% <200 mesh (U.S. Sieve Series) | 30 |
| Fuel Oil No. 6 | 67.65, 67.80 or 67.90 |
| Distilled Water | 2 |
| Stabilizer | 0.35, 0.20 or 0.10 |
| Total | 100 |

TABLE B

| Stabilizer | Conc. (% By Wt.) | PITTSTON COAL Sediment 1 Week | 2 Weeks | 3 Weeks | 4 Weeks | Total Rating |
|---|---|---|---|---|---|---|
| Tallow amine $(PO)_2$ | 0.35 | 1⅛" S | 1⅛" SF | — | — | 56 |
| | 0.20 | 1⅛" S | 1⅛" SF | — | — | |
| | 0.10 | 1 3/16" SF | — | — | — | |
| Tallow amine $(PO)_2)(EO)_7$ | 0.35 | 1" S | 1" S | 1" S | 1" SF | 168 |
| | 0.20 | 1" S | 1" S | 1⅛" S | 1⅛" SF | |
| | 0.10 | 1⅛" S | 1⅛" S | 1" S | 1⅛" SF | |
| Tallow amine $(PO)_2(EO)_{13}$ (Taken from Example I) | 0.35 | 1" S | 1" S | 1" S | 1' SF | 152 |
| | 0.20 | 1" S | 1" S | 1" S | 1" SF | |
| | 0.10 | 1" S | 1" S | 1" SF | — | |
| Tallow amine $(PO)_2(EO)_{18}$ (Taken from Example I) | 0.35 | 1" S | 1" S | 1" S | 1" S | 176 |
| | 0.20 | 1" S | 1" S | 1" S | 1" SF | |
| | 0.10 | 1" S | 1" S | 1" S | 1" SF | |
| Tallow amine $(PO)_2(EO)_{13}$ (Taken from Example II) | 0.35 | 1 3/16" S | 1 3/16" S | 1⅛" S | 1" S | 192 |
| | 0.20 | 1⅛" S | 1 1/16" S | 1⅛" S | 1" S | |
| | 0.10 | 1⅛" S | 1⅛" S | 1⅛" S | 1 3/16" S | |
| Tallow amine $(PO)_2(EO)_{18}$ | 0.35 | 1 3/16" S | 1⅛" S | 1 3/16" S | 1⅛" SF | 168 |

TABLE B-continued

| Stabilizer | Conc. (% By Wt.) | PITTSTON COAL Sediment 1 Week | 2 Weeks | 3 Weeks | 4 Weeks | Total Rating |
|---|---|---|---|---|---|---|
| (Taken from Example II) | 0.20 | 1" S | 1 3/16" S | 1 3/16" S | 1⅛" SF | |
| | 0.10 | 1⅛" S | 1¼" S | 1 3/16" S | 1⅛" SF | |

The data of Table B indicate that tallow amine $(PO)_2$ is an ineffective stabilizer for this slurry, whereas the use of the series of tallow amine $(PO)_2(EO)_7$ to tallow amine $(PO)_2(EO)_{18}$ rendered effective slurry stabilization. Unexpectedly, the total number of alkoxy groups seems to be the determining factor. Thus, a total of 9 to 20 alkoxy groups are required for effective stabilization of this slurry with no marked improvement beyond 15 alkoxy groups.

EXAMPLE IV

The effect of various alkoxylated tallow amine stabilizers on the consistency of slurries of coal and oil containing 0.35%, 0.20% or 0.10% by weight of stabilizer based on the weight of slurry was examined. The slurry compositions are given in Table A and the evaluation data are given in Table B. The following alkoxylated amines were used:

Tallow amine $(PO)_4(EO)_{11}$
Tallow amine $(PO)_4(EO)_{15}$

The sources of the fatty acid portions were the same as described in Example I.

Slurry preparation, experimental procedure and rating system were the same as described in Example I.

TABLE A

| Component | % By Wt. |
|---|---|
| Pittston Coal (80% <200 mesh (U.S. Sieve Series) | 30 |
| Fuel Oil No. 6 | 67.65, 67.80 or 67.90 |
| Distilled Water | 2 |
| Stabilizer | 0.35, 0.20 or 0.10 |
| Total | 100 |

TABLE B

| Stabilizer | Conc. (% By Wt.) | PITTSTON COAL Sediment 1 Week | 2 Weeks | 3 Weeks | 4 Weeks | Total Rating |
|---|---|---|---|---|---|---|
| Tallow amine $(EO)_{15}$ | 0.35 | 1" S | 1" S | 1" S | 1" SF | 168 |
| (Taken from Example I) | 0.20 | 1" S | 1" S | 1" S | 1" SF | |
| | 0.10 | 1" S | 1" S | 1" S | 1" SF | |
| Tallow amine $(PO)_2(EO)_{13}$ | 0.35 | 1" S | 1" S | 1" S | 1" SF | 152 |
| (Taken from Example I) | 0.20 | 1" S | 1" S | 1" S | 1" SF | |
| | 0.10 | 1" S | 1" S | 1" SF | — | |
| Tallow amine $(EO)_{15}$ | 0.35 | 1" S | 1 1/16" S | 1⅛" S | 1 1/16" SF | 168 |
| (Taken from Example II) | 0.20 | 1" S | 1 1/16" S | 1 1/16" S | 1⅛" SF | |
| | 0.10 | 1" S | 1 3/16" S | 1¼" S | 1 3/16" SF | |
| Tallow amine $(PO)_2(EO)_{13}$ | 0.35 | 1 3/16" S | 1 3/16" S | 1⅛" S | 1" S | 192 |
| (Taken from Example II) | 0.20 | 1⅛" S | 1 1/16" S | 1⅛" S | 1" S | |
| | 0.10 | 1⅛" S | 1⅛" S | 1⅛" S | 1 3/16" S | |
| Tallow amine $(PO)_4(EO)_{11}$ | 0.35 | 1" S | 1" S | 1" S | 1⅛" S | 184 |
| | 0.20 | 1⅛" S | 1⅛" S | 1⅛" S | 1" S | |
| | 0.10 | 1⅛" S | 1" S | 1" S | 1" SF | |
| Tallow amine $(PO)_4(EO)_{15}$ | 0.35 | 1" S | 1⅛" S | 1⅛" S | 1⅛" SF | 176 |
| | 0.20 | 1⅛" S | 1⅛" S | 1" S | 1⅛" S | |
| | 0.10 | 1" S | 1" S | 1" S | 1⅛" SF | |

The data of Table B reinforce the conclusions drawn from the data of Example III. A comparison of the use of tallow amines alkoxylated with 15 alkoxy groups, i.e., EO or PO and EO, indicates effective slurry stabilization. Thus, the total number of alkoxy groups seems to be the determining factor with very effective slurry stabilization, within a total of 15 alkoxy groups. In line with conclusions drawn from Examples I, II and III no marked improvement was observed beyond 15 alkoxy groups as exemplified also by the slurries stabilized with tallow amine $(PO)_4(EO)_{11}$ and tallow amine $(PO)_4(EO)_{15}$ with the former performing better.

EXAMPLE V

The effect of various mixtures of stabilizers on the consistency of slurries of coal and oil containing 0.35%, 0.20% or 0.10% by weight of stabilizer mixtures containing a quaternized imidazoline, which is a reaction product of oleic acid, aminoethylethanolamine and diethyl sulfate, and an alkoxylated tallow amine is illustrated in Tables C and D. The slurry compositions are given in Table A and the stabilizer compositions in Table B. Based on the findings of Examples III and IV, tallow amines alkoxylated with 15 alkoxy groups, i.e., ethylene oxide or propylene oxide and ethylene oxide, were selected for this comparison.

The sources of the fatty acid portions of the alkoxylated tallow amines were the same as described in Example I.

Slurry preparation, experimental procedure and rating system were the same as described in Example I.

TABLE A

| Component | % By Wt. |
|---|---|
| Pittston Coal or Ashland Coal (80% <200 mesh U.S. Sieve Series) | 30 |
| Fuel Oil No. 6 | 67.65, 67.80 or 67.90 |
| Distilled Water | 2 |
| Stabilizer Mixture | 0.35, 0.20 or 0.10 |
| Total | 100 |

TABLE B

| Stabilizer Composition | % By Wt. |
|---|---|
| A | |
| 1-Hydroxyethyl ethyl-2-heptadecenyl imidazoline quaternary ethyl sulfate | 15 |
| Tallow amine $(EO)_{15}$ | 85 |
| B | |
| 1-Hydroxyethyl ethyl-2-heptadecenyl imidazoline quaternary ethyl sulfate | 15 |
| Tallow amine $(PO)_2(EO)_{13}$ | 85 |
| C | |
| 1-Hydroxyethyl ethyl-2-heptadecenyl imidazoline quaternary ethyl sulfate | 15 |
| Catamine 1C + $(PO)_2(EO)_{13}$ | 85 |

TABLE C

| | | PITTSTON COAL | | | | |
|---|---|---|---|---|---|---|
| | | Sediment | | | | |
| Stabilizer | Conc. % By Wt.) | 1 Week | 2 Weeks | 3 Weeks | 4 Weeks | Total Rating |
| A | 0.35 | 1" S | 1⅛" S | 1" SF | — | 120 |
| | 0.20 | 1⅛" S | 1⅛" S | 1" SF | — | |
| | 0.10 | 1⅛" S | 1" S | 1⅛" SF | — | |
| B | 0.35 | 1⅛" S | 1" SF | — | — | 112 |
| | 0.20 | 1⅛" S | 1" S | 1⅛" S | — | |
| | 0.10 | 1⅛" S | 1" S | 1" SF | — | |
| C | 0.35 | 1⅛" S | 1" SF | — | — | 72 |
| | 0.20 | 1⅛" S | 1" SF | — | — | |
| | 0.10 | 1" S | 1⅛" SF | — | — | |

TABLE D

| | | ASHLAND COAL | | | | |
|---|---|---|---|---|---|---|
| | | Sediment | | | | |
| Stabilizer | Conc. (% By Wt.) | 1 Week | 2 Weeks | 3 Weeks | 4 Weeks | Total Rating |
| A | 0.35 | ⅞" S | 1⅛" S | 1¼" S | 1⅛" SF | 152 |
| | 0.20 | 1" S | 1⅛" S | 1⅛" S | 1⅛" SF | |
| | 0.10 | 1⅛" S | 1⅛" S | 1⅛" SF | — | |
| B | 0.35 | 1⅛" S | 1" S | ⅞" SF | — | 104 |
| | 0.20 | 1⅛" S | 1" S | 1" SF | — | |
| | 0.10 | 1⅛" S | 1⅛" SF | — | — | |
| C | 0.35 | 1" S | 1¼" S | 1" SF | — | 120 |
| | 0.20 | 1⅛" S | 1⅛" S | 1" SF | — | |
| | 0.10 | 1" S | 1¼" S | 1" SF | — | |

It is evident from the data of Tables C and D that with no exception the sediments remained soft after storage of one week at 70° C. and that the consistency decreased on further storage in the order of the mixtures A, B to C. However, compared to use of the imidazoline alone as a stabilizer (see Example I), mixture A showed improvement with both Pittston and Ashland coal oil slurries, mixture B showed improvement with Pittston coal oil slurries and no marked effect was observed with mixture C with both coals.

EXAMPLE VI

The results of Example V have been amplified as shown below. The effect of various mixtures of stabilizers on the consistency of slurries of coal and oil containing 0.35%, 0.20% or 0.1% by weight of stabilizer or stabilizer mixtures comprising a quaternized imidazoline (I) which is a reaction product of oleic acid, aminoethylethanolamine and diethyl sulfate, and an alkoxy tallow amine (TA) is illustrated in Tables C,D and E. The slurry compositions are given in Table A and the stabilizer compositions covering 100% TA; 85% TA/15% I; 50% TA/50% I; 15% TA/85% I, and 100% I in Table B.

The sources of the fatty acid portions of the alkoxylated tallow amines were the same as described in Example I.

Slurry preparation, experimental procedure and rating system were the same as described in Example I.

TABLE A

| Component | % By Wt. |
|---|---|
| Pittston Coal (80% <200 mesh U.S. Sieve Series) | 30 |
| Fuel Oil No. 6 | 67.65, 67.80 or 67.90 |
| Distilled Water | 2 |
| Stabilizer or Stabilizer Mixture | 0.35, 0.20 or 0.10 |
| Total | 100 |

TABLE B

| Stabilizer Composition | % By Wt. | | | | |
|---|---|---|---|---|---|
| A | | | | | |
| 1-Hydroxyethyl ethyl-2-heptadecenyl imidazoline quaternary ethyl sulfate | 100 | 85 | 50 | 15 | 0 |
| Tallow amine $(EO)_{15}$ | 0 | 15 | 50 | 85 | 100 |
| B | | | | | |
| 1-Hydroxyethyl ethyl-2-heptadecenyl imidazoline quaternary ethyl sulfate | 100 | 85 | 50 | 15 | 0 |
| Tallow amine $(PO)_2(EO)_{13}$ | 0 | 15 | 50 | 85 | 100 |
| C | | | | | |
| 1-Hydroxyethyl ethyl-2-heptadecenyl imidazoline quaternary ethyl sulfate | 100 | 85 | 50 | 15 | 0 |
| Catamine 1C $(PO)_2(EO)_{13}$ | 0 | 15 | 50 | 85 | 100 |

TABLE C

| | | PITTSTON COAL | | | | |
|---|---|---|---|---|---|---|
| Stabilizer | | Sediment | | | | |
| A Compositions | Conc. (% By Wt.) | 1 Week | 2 Weeks | 3 Weeks | 4 Weeks | Rating |
| 100% TA | 0.35 | 1 3/16" S | 1 3/16" S | 1" S | 1⅛" S | 184 |
| | 0.20 | 1⅛" S | 1⅛" S | 1⅛" S | 1⅛" S | |
| | 0.10 | 1 3/16" S | 1⅛" S | 1" S | 1⅛" SF | |
| 85% TA/15% I | 0.35 | 1" S | 1" S | 1⅛" SF | — | 152 |
| | 0.20 | 1" S | 1" S | 1" S | 1⅛" SF | (120-Ex. V) |
| | 0.10 | 1" S | 1 3/16" S | 1 1/16" S | 1 3/16" SF | |
| 50% TA/50% I | 0.10 | 1" S | 1" SF | — | — | 72 |
| | 0.20 | 1" S | 1" SF | — | — | |
| | 0.35 | 1" S | 1" SF | — | — | |
| 15% TA/85% I | 0.35 | 1" SF | — | — | — | 72 |
| | 0.20 | 1" S | 1⅛" SF | — | — | |
| | 0.10 | 1" S | 1" S | 1" SF | — | |
| 100% I | 0.35 | 1" S | 1" SF | — | — | 88 |
| | 0.20 | 1" S | 1⅛" SF | — | — | |
| | 0.10 | 1⅛" S | 1" S | 1⅛" SF | — | |

TABLE D

| Stabilizer | | PITTSTON COAL Sediment | | | | Total |
|---|---|---|---|---|---|---|
| B Compositions | Conc. (% By Wt.) | 1 Week | 2 Weeks | 3 Weeks | 4 Weeks | Rating |
| 100% TA | 0.35 | 1⅛" S | 1⅛" S | 1⅛" S | 1" S | 176 |
| | 0.20 | 1⅛" S | 1" S | 1⅛" S | 1⅛" SF | |
| | 0.10 | 1⅛" S | 1⅛" S | 1⅛" S | 1⅛" SF | |
| 85% TA/15% I | 0.35 | 1" S | 1" S | 1" S | 1⅛" SF | 152 |
| | 0.20 | 1⅛" S | 1" S | 1" S | 1⅛" SF | (112-Ex. V) |
| | 0.10 | 1" S | 1" S | 1" SF | — | |
| 50% TA/50% I | 0.35 | 1" S | 1" SF | — | — | 104 |
| | 0.20 | 1" S | 1" S | 1⅛" SF | — | |
| | 0.10 | 1⅛" S | 1" S | 1⅛" SF | — | |
| 15% TA/85% I | 0.35 | 1" S | 1" SF | — | — | 72 |
| | 0.20 | 1" S | 1⅛" SF | — | — | |
| | 0.10 | 1⅛" S | 1" SF | — | — | |
| 100% I | 0.35 | 1" S | 1" SF | — | — | 88 |
| | 0.20 | 1" S | 1⅛" SF | — | — | |
| | 0.10 | 1⅛" S | 1" S | 1⅛" SF | — | |

TABLE E

| Stabilizer | | PITTSTON COAL Sediment | | | | |
|---|---|---|---|---|---|---|
| C Compositions | Conc. (% By Wt.) | 1 Week | 2 Weeks | 3 Weeks | 4 Weeks | Rating |
| 100% TA | 0.35 | 1 3/16" S | 1" S | 1⅛" S | 1⅛" SF | 168 |
| | 0.20 | 1¼" S | 1 3/16" S | 1⅛" S | 1⅛" SF | |
| | 0.10 | 1" S | 1⅛" S | 1⅛" S | 1⅛" SF | |
| 85% TA/15% I | 0.35 | 1 3/16" S | 1¼" SF | — | 104 | |
| | 0.20 | 1⅛" S | 1 3/16" S | 1⅛" SF | — | (72-Ex. V) |
| | 0.10 | 1⅛" S | 1⅛" S | 1⅛" SF | | |
| 50% TA/50% I | 0.35 | 1" SF | — | — | — | 72 |
| | 0.20 | 1" S | 1⅛" SF | — | — | |
| | 0.10 | 1⅛" S | 1" S | 1" SF | — | |
| 15% TA/85% I | 0.35 | 1⅛" S | — | — | — | 56 |
| | 0.20 | 1" S | 1" SF | — | — | |
| | 0.10 | 1" S | 1⅛" SF | — | — | |
| 100% I | 0.35 | 1" S | 1" SF | — | — | 88 |
| | 0.20 | 1" S | 1⅛" SF | — | — | |
| | 0.10 | 1⅛" S | 1" S | 1⅛" SF | — | |

It is evident from the data presented in Tables C, D and E in analogy with the data of Examples I and II, that all slurries stabilized with alkoxylated amines performed better than the slurries stabilized with quaternized imidazoline alone. Furthermore, it was demonstrated that performance of the quaternized imidazoline could be markedly improved by addition of more than 50% by weight of alkoxylated tallow amines, particularly with tallow amine $(PO)_2(EO)_{13}$. This improvement was already noticeable at 50% addition.

While the invention has been described in detail and with reference to specific embodiments thereof, it will be apparent that various changes and modifications can be made therein which are within the full intended scope of the appended claims.

What is claimed is:

1. A slurry of solid particulate carbonaceous material in oil containing at least one stabilizer having the formula

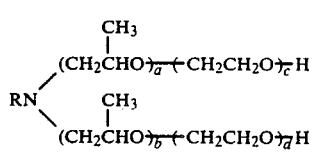

where R is a straight or branched saturated or unsaturated hydrocarbon chain of 12 to 18 carbon atoms, a+b totals from about 2 to about 4 and c+d totals from about 7 to about 22, said stabilizer present in an amount sufficient to stabilize said slurry.

2. The slurry of claim 1 wherein there is present from about 40 to about 90 parts by weight of oil, about 10 to about 60 parts by weight of carbonaceous material, about 0.01 to about 10 parts by weight of stabilizer and optionally up to about 20 parts by weight of water.

3. The slurry of claim 2 wherein said carbonaceous material is coal.

4. The slurry of claim 2 wherein said stabilizer is tallow amine first condensed with about 2 moles of propylene oxide and then condensed with about 7 moles of ethylene oxide.

5. The slurry of claim 2 wherein said stabilizer is tallow amine first condensed with about 2 moles of propylene oxide and then condensed with about 13 moles of ethylene oxide.

6. The slurry of claim 2 wherein said stabilizer is tallow amine first condensed with about 2 moles of propylene oxide and then condensed with about 17 moles of ethylene oxide.

7. The slurry of claim 2 wherein said stabilizer is tallow amine first condensed with about 2 moles of propylene oxide and then condensed with about 18 moles of ethylene oxide.

8. The slurry of claim 2 wherein said stabilizer is tallow amine first condensed with about 2 moles of propylene oxide and then condensed with about 22 moles of ethylene oxide.

9. The slurry of claim 2 wherein said stabilizer is tallow amine first condensed with about 4 moles of propylene oxide and then condensed with about 11 moles of ethylene oxide.

10. The slurry of claim 2 wherein said stabilizer is tallow amine first condensed with about 4 moles of propylene oxide and then condensed with about 15 moles of ethylene oxide.

11. A stabilizer composition for slurries of solid particulate carbonaceous material in oil comprising a mixture of (a) at least one stabilizer having the formula

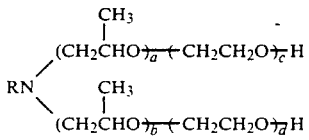

where R is a straight or branched saturated or unsaturated hydrocarbon chain of 12 to 18 carbon atoms a+b totals from about 2 to about 4 and c+d totals from about 7 to about 22 and (b) at least one imidazoline quaternary salt of the formula

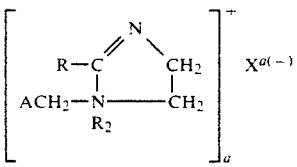

wherein:

R is a hydrocarbon radical having 9 to 23 carbon atoms, A is a

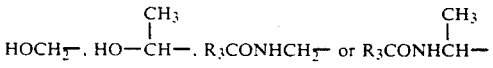

radical where $R_3$ is oleyl or stearyl, $R_2$ is hydrogen, an unsubstituted or hydroxy-substituted aliphatic hydrocarbon radical having 1 to 6 carbon atoms or a benzyl radical, X is a water-soluble anion, and a is a number equal to the ionic valence of the anion, X, said mixture containing at least 50% by weight of (a).

12. The composition of claim 11 wherein said (b) is 1-hydroxyethyl ethyl-2-heptadecenyl imidazoline quaternary ethyl sulfate.

13. A slurry of solid particulate carbonaceous material in oil containing the stabilizer composition of claim 11, said stabilizer present in an amount sufficient to stabilize said slurry.

14. A process for preparing stable oil slurries of solid particulate carbonaceous material comprising incorporating into said slurry at least one stabilizer having the formula

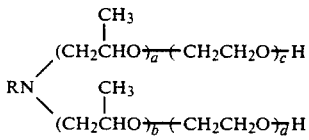

where R is a straight or branched saturated or unsaturated hydrocarbon chain of 12 to 18 carbon atoms a+b totals from about 2 to about 4 and c+d totals from about 7 to about 22 in an amount sufficient to stabilize said slurry.

15. The process of claim 14 wherein said carbonaceous material is coal.

16. The process of claim 15 wherein said stabilizer is tallow amine first condensed with about 2 moles of propylene oxide and then condensed with about 13 moles of ethylene oxide.

17. A process for preparing stable oil slurries of solid particulate carbonaceous material comprising incorporating into said slurry the stabilizer composition of claim 11 in an amount sufficient to stabilize said slurry.

18. The process of claim 17 wherein the solid particulate carbonaceous material is coal.

* * * * *